US007799985B2

(12) United States Patent
Yanase et al.

(10) Patent No.: US 7,799,985 B2
(45) Date of Patent: Sep. 21, 2010

(54) ELECTRONIC MUSICAL APPARATUS, CONTROL METHOD THEREFOR, AND STORAGE MEDIUM STORING INSTRUCTIONS FOR IMPLEMENTING THE METHOD

(75) Inventors: Tsutomu Yanase, Hamamatsu (JP); Tomoyuki Kageyama, Tokyo (JP)

(73) Assignee: Yamaha Corporation, Hamamatsu-shi (JP)

( * ) Notice: Subject to any disclaimer, the term of this patent is extended or adjusted under 35 U.S.C. 154(b) by 1154 days.

(21) Appl. No.: 11/181,629

(22) Filed: Jul. 13, 2005

(65) Prior Publication Data

US 2006/0054008 A1 Mar. 16, 2006

(30) Foreign Application Priority Data

Jul. 14, 2004 (JP) ..... 2004-207505
Aug. 4, 2004 (JP) ..... 2004-228150

(51) Int. Cl.
*G10H 1/06* (2006.01)

(52) U.S. Cl. ..... 84/622; 84/601; 84/645

(58) Field of Classification Search ..... 84/601, 84/622, 645
See application file for complete search history.

(56) References Cited

U.S. PATENT DOCUMENTS 5,750,913 A 5/1998 Kamiya
5,892,171 A 4/1999 Ide et al.
6,180,862 B1 * 1/2001 Hirano ..... 84/601
6,369,310 B1 * 4/2002 Brunson et al. ..... 84/600
6,423,893 B1 * 7/2002 Sung et al. ..... 84/645
7,421,434 B2 9/2008 Fujiwara
2001/0035088 A1 11/2001 Faecher
2002/0046899 A1 4/2002 Mizuno et al.
2002/0056117 A1 5/2002 Hasegawa et al.
2002/0062261 A1 * 5/2002 Mukai ..... 705/26
2002/0091455 A1 * 7/2002 Williams ..... 700/94
2003/0167904 A1 9/2003 Itoh
2004/0011190 A1 1/2004 Kawashima (Continued)

FOREIGN PATENT DOCUMENTS

EP 1 209 581 5/2002

(Continued)

OTHER PUBLICATIONS

European search report for European Patent Application No. 05106396.4 mailed Dec. 6, 2005.

(Continued)

*Primary Examiner*—Walter Benson
*Assistant Examiner*—Kawing Chan
(74) *Attorney, Agent, or Firm*—Morrison & Foerster LLP

(57) ABSTRACT

An electronic musical apparatus which makes it possible to execute functions provided in advance in the electronic musical apparatus. Contents data including link information indicative of a link to a file in which at least one command for executing at least one predetermined function provided in the electronic musical apparatus is written is acquired. A predetermined screen is displayed based on the acquired contents data. The file linked by the link information is acquired when a user performs a predetermined operation on the link information presented on the displayed predetermined screen. At least one command written in the acquired file is interpreted, and the electronic musical apparatus is controlled to execute at least one predetermined function indicated by the interpreted command.

21 Claims, 9 Drawing Sheets

U.S. PATENT DOCUMENTS

2004/0144236 A1* 7/2004 Hiratsuka ..... 84/609

FOREIGN PATENT DOCUMENTS

| | | | |
|---|---|---|---|
| JP | 2937066 | B2 | 6/1999 |
| JP | 2002-142044 | | 5/2002 |
| JP | 2003-255934 | | 9/2003 |
| JP | 2003-255934 | A | 9/2003 |
| JP | 2006-065010 | A | 3/2006 |
| TW | 411435 | | 11/2000 |
| TW | 2005-14020 | | 4/2005 |

OTHER PUBLICATIONS

First Office Action mailed May 8, 2009, for CN Application No. 200510083386.8, with English translation, 18 pages.
Office Action mailed Dec. 15, 2009, for JP Demand for Trial No. 2009-013020 in the matter of JP Application No. 2004-228150, with English Translation, five pages.
Australian Search Report mailed Sep. 6, 2006 for SG Application No. 200504433-4, eight pages.
Decision of Rejection mailed Apr. 28, 2009, for JP Application No. 2004-228150, with English translation, six pages.
Information Statement mailed Dec. 26, 2008, for JP Application No. 2004-228150, with English translation, nine pages.
Korean Office Action mailed Nov. 23, 2006, for KR Application No. 10-2005-63699, with English Translation, eight pages.
Notice of Reasons for Rejection mailed Feb. 3, 2009, for JP Application No. 2004-228150, with English translation, 11 pages.
Office Action mailed Dec. 28, 2006, for European Patent Application No. 05 106 396.4-2218, 10 pages.
Extended European Search Report, mailed Jan. 16, 2007, for European Patent Application No. 06120129.9-2225, 15 pages.
Extended European Search Report, mailed Jan. 16, 2007, for European Patent Application No. 06120141.4-2225, 15 pages.
Office Action mailed Jun. 11, 2007, for European Patent Application No. 05 106 396.4-2225, 15 pages.
Office Action mailed Sep. 5, 2007, for European Patent Application No. 06120129.9-2225, 1 page.
Office Action mailed Sep. 5, 2007, for European Patent Application No. 06120141.4-2225, 1 page.
Office Action mailed Mar. 11, 2008, for Canadian Patent Application No. 2,512,109, 3 pages.
Trial Decision mailed Apr. 6, 2010, for Japanese Patent Application No. 2004-228150, Japanese Trial No. 2009-13020 with English Translation, 34 pages.

* cited by examiner

*FIG. 4*

```
<HTML>
<HEAD>
<TITLE>REGISTRATION SETTING</TITLE>
<script language="JavaScript">
    function Button1(){
    <EMI com>SetAssignableButton(Registration1)</EMI com>; //describe electronic musical apparatus control command and parameters
    }
    function Button2(){
    <EMI com>SetAssignableButton(Registration2)</EMI com>; //describe electronic musical apparatus control command and parameters
    }
    function Button3(){
    <EMI com>SetAssignableButton(Registration3)</EMI com>; //describe electronic musical apparatus control command and parameters
    }
</script>
</HEAD>
<BODY>
<H1>REGISTRATION IS SET</H1>
<FORM>
FOR MUSIC aaaa ... CLICK HERE
<INPUT TYPE="Button" //DESIGNATION OF BUTTON
    VALUE="aaaa" //DISPLAY CHARACTERS ON BUTTON
    onClick="Button1()">
</BR>
FOR MUSIC bbbb ... CLICK HERE
<INPUT TYPE="Button" //DESIGNATION OF BUTTON
    VALUE="bbbb" //DISPLAY CHARACTERS ON BUTTON
    onClick="Button2()">
</BR>
FOR MUSIC cccc ... CLICK HERE
<INPUT TYPE="Button" //DESIGNATION OF BUTTON
    VALUE="cccc" //DISPLAY CHARACTERS ON BUTTON
    onClick="Button3()">
</FORM>
</BODY>
</HTML>
```

*FIG. 6*

```
<HTML>
<HEAD>
<TITLE>REGISTRATION SETTING</TITLE>
<script language="JavaScript">
    function Auto(){
        <EMI com>SetAssignableButton(Registration1)</EMI com>; //describe electronic musical apparatus control command and parameters
    }
</script>
</HEAD>
<BODY>
<H1>REGISTRATION HAS BEEN SET FOR BUTTON</H1>
<FORM>
<BODY onLoad="Auto()">
</FORM>
</BODY>
</HTML>
```

*FIG. 9A*

102b

| |
|---|
| REMOTE CONTROL DATA 1 |
| REMOTE CONTROL DATA 2 |
| ⋮ |

*FIG. 9B*

| CONTROL ITEM | EXAMPLES OF DESCRIPTION |
|---|---|
| PANEL SCREEN | <PANEL SCORE="OPEN"> |
| SONG CONTROL | <SONG-CTRL PLAY="STOP"> |
| SONG SETTING | <SONG-SET VOLUME-ABS="100"> |
| TEMPO SETTING | <TEMPO VALUE-ABS="120"> |
| TRANSPOSE SETTING | <TRANSPOSE SONG-ABS="5"> |
| GUIDE SETTING | <GUIDE MODE="ON" LAMP="ON" LEFTCH="OFF" RIGHTCH="1"> |
| KEYBOARD TONE SETTING | <MAIN-VOICE MSB="0" LSB="112" PROGRAM-NO="6" VOLUME-ABS="100"> |
| AUTOMATIC ACCOMPANIMENT SETTING | <ACM-CTRL MODE="OFF"> |
| AUTOMATIC PERFORMANCE MUSIC REPRODUCTION | <SONG-PGM NEXT="1"> |
| SONG TRACK | <SONG-TRACK TR1="ON" TR2="ON" TR3="OFF" TR10="OFF" TR16="OFF"> |
| BULK SETTING | <BULK STATE="RESET"> |

ELECTRONIC MUSICAL APPARATUS, CONTROL METHOD THEREFOR, AND STORAGE MEDIUM STORING INSTRUCTIONS FOR IMPLEMENTING THE METHOD

BACKGROUND OF THE INVENTION

1. Field of the Invention

The present invention relates to an electronic musical apparatus that has a Web browser installed therein and uses supplied Web contents data via the Web browser, a control method for the electronic musical apparatus, and a storage medium storing instructions for implementing the control method.

2. Description of the Related Art

Conventionally, there has been known an electronic musical apparatus which has a Web browser installed therein and uses (for example, view) supplied Web contents data via the Web browser.

As an advanced type of this electronic musical apparatus, an electronic musical apparatus has been proposed which not only uses supplied Web contents data, but also acquires a script for expanding the functions of the electronic musical apparatus as well as the Web contents data and expands the functions of the electronic musical apparatus according to this script (see Japanese Laid-Open Patent Publication (Kokai) No. 2003-255934, for example).

However, in the above conventional electronic musical apparatus, although the functions of the electronic musical apparatus can be expanded using the supplied Web contents data and the script, functions provided in advance in the electronic musical apparatus cannot be executed using the supplied Web contents data and the script.

SUMMARY OF THE INVENTION

It is an object of the present invention to provide an electronic musical apparatus which makes it possible to execute functions provided in advance in the electronic musical apparatus, a control method for the electronic musical apparatus, and a storage medium storing instructions for implementing the control method.

To attain the above object, in a first aspect of the present invention, there is provided an electronic musical apparatus comprising a first acquiring device that acquires contents data including link information indicative of a link to a file in which at least one command for executing at least one predetermined function provided in the electronic musical apparatus is written, a display device that displays a predetermined screen based on the contents data acquired by the first acquiring device, a second acquiring device that is operable when a user performs a predetermined operation on a display element relating to the link information on the predetermined screen displayed by the display device, to acquire the file linked by the link information, and a control device that interprets the at least one command written in the file acquired by the second acquiring device and controls the electronic musical apparatus to execute the at least one predetermined function indicated by the interpreted command.

With the arrangement of the first aspect of the present invention, link information indicative of a link to a file in which at least one command for executing at least one predetermined function provided in advance in the electronic musical apparatus is written is included in contents data, and when the user performs a predetermined operation on the link information presented on a predetermined screen displayed on the display device, the file linked by the link information is acquired. The at least one command written in the acquired file is interpreted and executed. As a result, the corresponding function of the electronic musical apparatus is executed, and thus the function provided in advance in the electronic musical apparatus can be executed. Also, since the file is formed of a file other than a file that contains the contents data, one file can be shared by a plurality of contents data. Further, since it is only necessary to include the link information indicative of a link to the file in the contents data, the contents data can be easily created.

Preferably, the first acquiring device, the display device, and the second acquiring device are realized by a browser, the control device is realized by a function executing section, and the browser activates the function executing section to execute the at least one predetermined function indicated by the interpreted command.

More preferably, a file extension is appended to the file, and the browser identifies the file extension to activate the function executing section.

Preferably, the control device controls the electronic musical apparatus not to execute the function indicated by the interpreted command when the function indicated by the interpreted command is a function that is not provided in the electronic musical apparatus.

Preferably, the file is linked by link information owned by other contents data.

Preferably, the function executed by the electronic musical apparatus under control of said control device includes at least one function selected from the group consisting of a function of opening or closing a screen on said display device, a function of controlling reproduction of musical composition data, a function of setting a volume value of a song to be reproduced based on musical composition data, a function of setting a tempo value of a song to be reproduced based on musical composition data, a function of setting a transpose value of a keyboard or a song to be reproduced, a function relating to setting of performance guide, a function relating to setting of a tone to be generated by operation of a keyboard, a function relating to setting of automatic accompaniment, a function of designating a musical composition to be automatically reproduced, a function relating to setting as to reproduction of a song track, a function of collectively setting musical instrument status, a function of assigning setting data for setting tone color or accompaniment of a musical composition to be performed based on musical composition data to a predetermined operating element, a function of setting tone color or accompaniment of a musical composition, a function of loading musical composition data from an external storage medium and instructing reproduction of the loaded musical composition data, and a function of assigning an instruction for sending data to an external apparatus to a predetermined operating element.

To attain the above object, in a second aspect of the present invention, there is provided an electronic musical apparatus comprising an acquiring device that acquires contents data in which at least one command for executing at least one predetermined function provided in the electronic musical apparatus is embedded, and a control device that is responsive to a predetermined operation by a user to interpret the at least one command embedded in the contents data acquired by the acquiring device and controls the electronic musical apparatus to execute the at least one predetermined function indicated by the interpreted command.

With the arrangement of the second aspect of the present invention, at least one command embedded in contents data acquired by the acquiring device is interpreted in response to a predetermined operation by a user, and the electronic musical apparatus is controlled to execute at least one predetermined function indicated by the interpreted command. As a result, functions provided in the electronic musical apparatus can be executed.

Preferably, the function executed by the electronic musical apparatus under control of said control device includes at least one function selected from the group consisting of a function of opening or closing a screen on said display device, a function of controlling reproduction of musical composition data, a function of setting a volume value of a song to be reproduced based on musical composition data, a function of setting a tempo value of a song to be reproduced based on musical composition data, a function of setting a transpose value of a keyboard or a song to be reproduced, a function relating to setting of performance guide, a function relating to setting of a tone to be generated by operation of a keyboard, a function relating to setting of automatic accompaniment, a function of designating a musical composition to be automatically reproduced, a function relating to setting as to reproduction of a song track, a function of collectively setting musical instrument status, a function of assigning setting data for setting tone color or accompaniment of a musical composition to be performed based on musical composition data to a predetermined operating element, a function of setting tone color or accompaniment of a musical composition, a function of loading musical composition data from an external storage medium and instructing reproduction of the loaded musical composition data, and a function of assigning an instruction for sending data to an external apparatus to a predetermined operating element.

Preferably, the contents data further includes music contents, and the command is for executing at least one function relating to the music contents.

To attain the above object, in a third aspect of the present invention, there is provided an electronic musical apparatus comprising an acquiring device that acquires contents data in which at least one command for executing at least one predetermined function provided in the electronic musical apparatus is embedded, a display device that displays a predetermined screen based on the contents data acquired by the acquiring device, and a control device that is operable when a user performs a predetermined operation on a display element displayed on the predetermined screen displayed by the display device, to interpret the at least one command embedded in the contents data acquired by the acquiring device and control the electronic musical apparatus to execute the at least one predetermined function indicated by the interpreted command.

With the arrangement of the third aspect of the present invention, a predetermined screen is displayed based on the contents data acquired by the acquiring device, and when a user performs a predetermined operation on a display element displayed on the displayed predetermined screen, at least one command embedded in the acquired contents data is interpreted, and the electronic musical apparatus is controlled to execute at least one predetermined function indicated by the interpreted command. As a result, functions provided in advance in the electronic musical apparatus can be executed.

Preferably, the function executed by the electronic musical apparatus under control of said control device includes at least one function selected from the group consisting of a function of opening or closing a screen on said display device, a function of controlling reproduction of musical composition data, a function of setting a volume value of a song to be reproduced based on musical composition data, a function of setting a tempo value of a song to be reproduced based on musical composition data, a function of setting a transpose value of a keyboard or a song to be reproduced, a function relating to setting of performance guide, a function relating to setting of a tone to be generated by operation of a keyboard, a function relating to setting of automatic accompaniment, a function of designating a musical composition to be automatically reproduced, a function relating to setting as to reproduction of a song track, a function of collectively setting musical instrument status, a function of assigning setting data for setting tone color or accompaniment of a musical composition to be performed based on musical composition data to a predetermined operating element, a function of setting tone color or accompaniment of a musical composition, a function of loading musical composition data from an external storage medium and instructing reproduction of the loaded musical composition data, and a function of assigning an instruction for sending data to an external apparatus to a predetermined operating element.

More preferably, the contents data further includes music contents, and the command is for executing at least one function relating to the music contents.

To attain the above object, in a fourth aspect of the present invention, there is provided a control method for an electronic musical apparatus, comprising a first acquiring step of acquiring contents data including link information indicative of a link to a file in which at least one command for executing at least one predetermined function provided in the electronic musical apparatus is written, a display step of causing a display device to display a predetermined screen based on the contents data acquired in the first acquiring step, a second acquiring step of acquiring the file linked by the link information when a user performs a predetermined operation on a display element relating to the link information on the predetermined screen displayed in the display step, and a control step of interpreting the at least one command written in the file acquired in the second acquiring step and controlling the electronic musical apparatus to execute the at least one predetermined function indicated by the interpreted command.

According to the fourth aspect of the present invention, the same effects as those obtained by the electronic musical apparatus according to the first aspect can be obtained.

To attain the above object, in a fifth aspect of the present invention, there is provided a control method for an electronic musical apparatus, comprising an acquiring step of acquiring contents data in which at least one command for executing at least one predetermined function provided in the electronic musical apparatus is embedded, and a control step of interpreting the at least one command embedded in the contents data acquired in the acquiring step and controlling the electronic musical apparatus to execute the at least one predetermined function indicated by the interpreted command, in response to a predetermined operation by a user.

According to the fifth aspect of the present invention, the same effects as those obtained by the electronic musical apparatus according to the second aspect can be obtained.

To attain the above object, in a sixth aspect of the present invention, there is provided a control method for an electronic musical apparatus, comprising an acquiring step of acquiring contents data in which at least one command for executing at least one predetermined function provided in the electronic musical apparatus is embedded, a display step of causing a display device to display a predetermined screen based on the contents data acquired in the acquiring step, and a control step of interpreting the at least one command embedded in the contents data acquired in the acquiring step and controlling the electronic musical apparatus to execute the at least one predetermined function indicated by the interpreted command when a user performs a predetermined operation on a display element displayed on the predetermined screen displayed in the display step.

According to the sixth aspect of the present invention, the same effects as those obtained by the electronic musical apparatus according to the third aspect can be obtained.

Further, to attain the above object, in a seventh aspect of the present invention, there is provided a mechanically readable storage medium storing instructions for causing a machine to execute the control method according to the fourth aspect.

According to the seventh aspect of the present invention, the same effects as those obtained by the electronic musical apparatus according to the first aspect can be obtained.

Further, to attain the above object, in an eighth aspect of the present invention, there is provided a mechanically readable storage medium storing instructions for causing a machine to execute the control method according to the fifth aspect.

According to the eighth aspect of the present invention, the same effects as those obtained by the electronic musical apparatus according to the second aspect can be obtained.

Further, to attain the above object, in a ninth aspect of the present invention, there is provided a mechanically readable storage medium storing instructions for causing a machine to execute the control method according to the sixth aspect.

According to the ninth aspect of the present invention, the same effects as those obtained by the electronic musical apparatus according to the third aspect can be obtained.

The above and other objects, features, and advantages of the invention will become more apparent from the following detained description taken in conjunction with the accompanying drawings.

BRIEF DESCRIPTION OF THE DRAWINGS

FIG. 4 is a view showing an example of contents data description;

FIG. 6 is a view showing another example of the contents data description in FIG. 2;

FIG. 9A is a diagram showing an example of a data format of a remote control file appearing in FIG. 7;

FIG. 9B is a diagram showing an example of remote control data written in the remote control file in FIG. 7.

DETAILED DESCRIPTION OF THE PREFERRED EMBODIMENTS

The present invention will now be described in detail with reference to the accompanying drawings showing preferred embodiments thereof.

Figure 1:
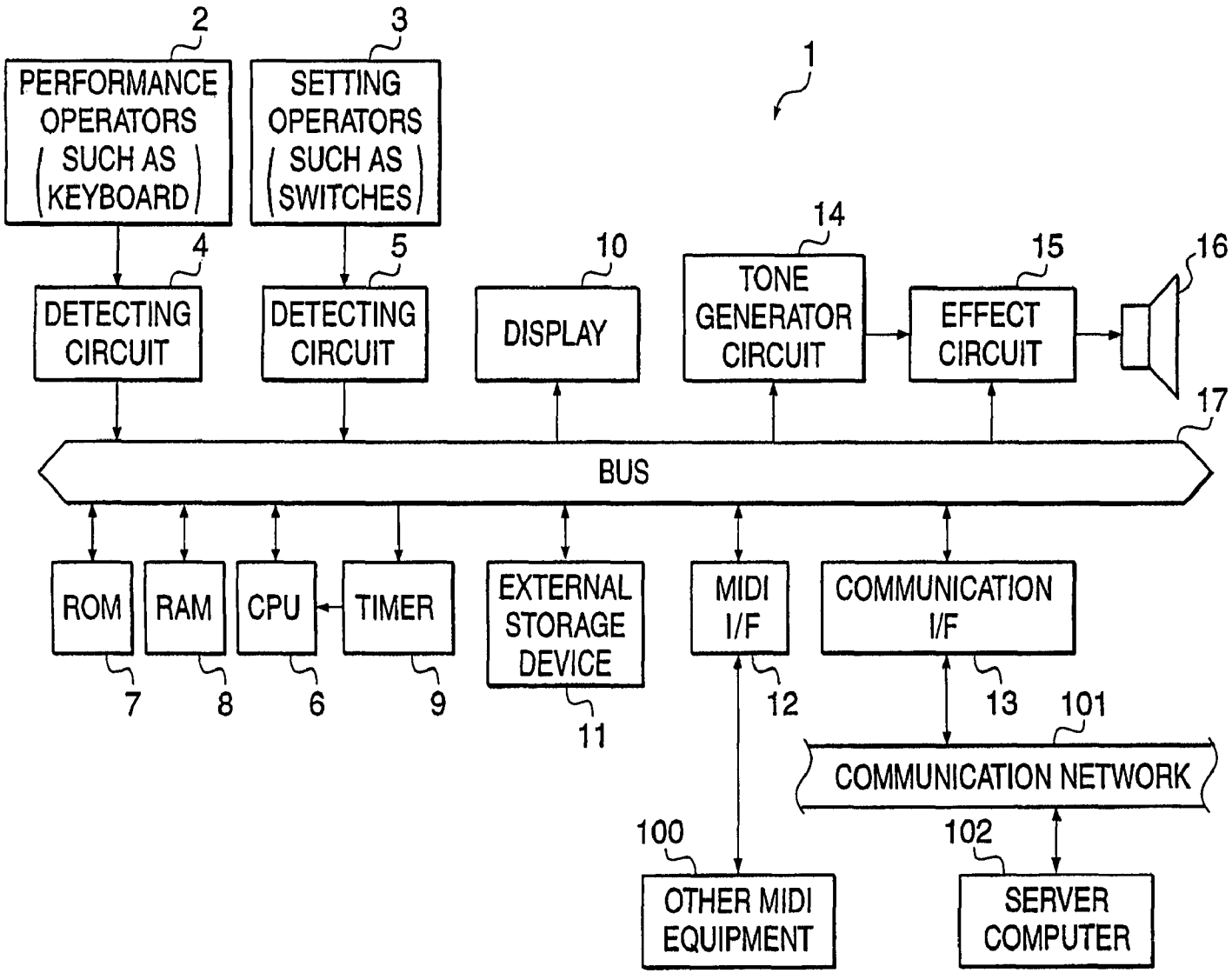
FIG. 1 is a block diagram schematically showing the arrangement of an electronic musical apparatus according to a first embodiment of the present invention.

FIG. 1 is a block diagram schematically showing the arrangement of an electronic musical apparatus 1 according to a first embodiment of the present invention.

As shown in FIG. 1, the electronic music apparatus 1 according to the present embodiment is comprised of performance operators 2 including a keyboard for inputting pitch information; setting operators 3 including a plurality of switches, a keyboard, and a mouse for inputting various kinds of information; a detecting circuit 4 for detecting operative states of the performance operators 2; a detecting circuit 5 for detecting operative states of the setting operators 3; a CPU 6 that controls the entire apparatus; a ROM 7 that stores control programs executed by the CPU 6, various table data, etc.; a RAM 8 for temporarily storing performance data, various input information, computation results, etc.; a timer 9 that measures an interrupt time for timer interrupt processing and various kinds of time; a display 10 comprised of a liquid crystal display (LCD) or a CRT (Cathode Ray Tube) and light emitting diodes (LEDs); an external storage device 11 that stores various application programs including control programs, various musical composition data, and various other data; a MIDI interface (I/F) 12 that inputs MIDI (Musical Instrument Digital Interface) messages from external devices and outputs MIDI messages to external devices; a communication interface (I/F) 13 that performs transmission and reception of data to and from a server computer (hereinafter simply referred to as "the server") 102 via a communication network 101; a tone generator circuit 14 that converts performance data input by the performance operators 2, preset performance data, and other data into musical tone signals; an effect circuit 15 that applies various effects to musical tone signals from the tone generator circuit 14; and a sound system 16 that converts musical tone signals from the effect circuit 15 into sounds and is comprised of a DAC (Digital-to-Analog Converter), an amplifier, a speaker, etc.

The above component elements 4 to 15 are connected to each other via a bus 17. The timer 9 is connected to the CPU 6, other MIDI equipment 100 to the MIDI I/F 11, the communication network 101 to the communication I/F 13, the effect circuit 15 to the tone generator circuit 14, and the sound system 16 to the effect circuit 15, respectively. Here, the communication I/F 13 and the communication network 101 should not necessarily be wired, but may be wireless. Alternatively, one may be wired and the other may be wireless The external storage device 11 may be implemented, for example, by a flexible disk drive (FDD), a hard disk drive (HDD), a CD-ROM drive, or a magnetic-optical disk drive (MO). The external storage device 11 may store the control programs executed by the CPU 6 as mentioned above. If one or more of the control programs are not stored in the ROM 7, the control program(s) may be stored in the external storage device 11, and by reading out the control program(s) from the external storage device 11 and storing the same in the RAM 8, the CPU 6 can operate in the same manner as if the control program(s) were stored in the ROM 7. This enables adding control programs and upgrading the version of the control programs with ease.

The MIDI I/F 12 need not be a dedicated one, but may be implemented by a universal interface such as RS-232C, USB (Universal Serial Bus), and IEEE1394. In this case, data other than MIDI message data may be transmitted and received simultaneously via the MIDI I/F 12.

As mentioned above, the communication I/F 13 is connected to the communication network 101 which may be a LAN (Local Area Network), the Internet, a telephone line, or the like, for connection to the server 102 via the communication network 101. When one or more of the above programs and various parameters are not stored in the external storage device 11, the communication I/F 13 is used to download such programs and parameters from the server 102. The electronic musical apparatus 1 as a client transmits a command or commands for downloading one or more programs and parameters to the server 102 via the communication I/F 13 and the communication network 101. In response to the command, the server 102 distributes the requested program(s) and parameters to the electronic musical apparatus 1 via the communication network 101, and the electronic musical apparatus 1 receives the program(s) and parameters via the communication I/F 13 and stores them in the external storage device 11, thus completing the download.

In the present embodiment, the server 102 is a Web server that distributes contents (Web page data). The Web server 102 can be comprised of the same component elements as those of the electronic musical apparatus 1, but the performance operators 2, detecting circuit 4, and MIDI I/F 12 may be omitted because they are not essential elements. In general, a server computer is used as the Web server 102.

Figure 2:
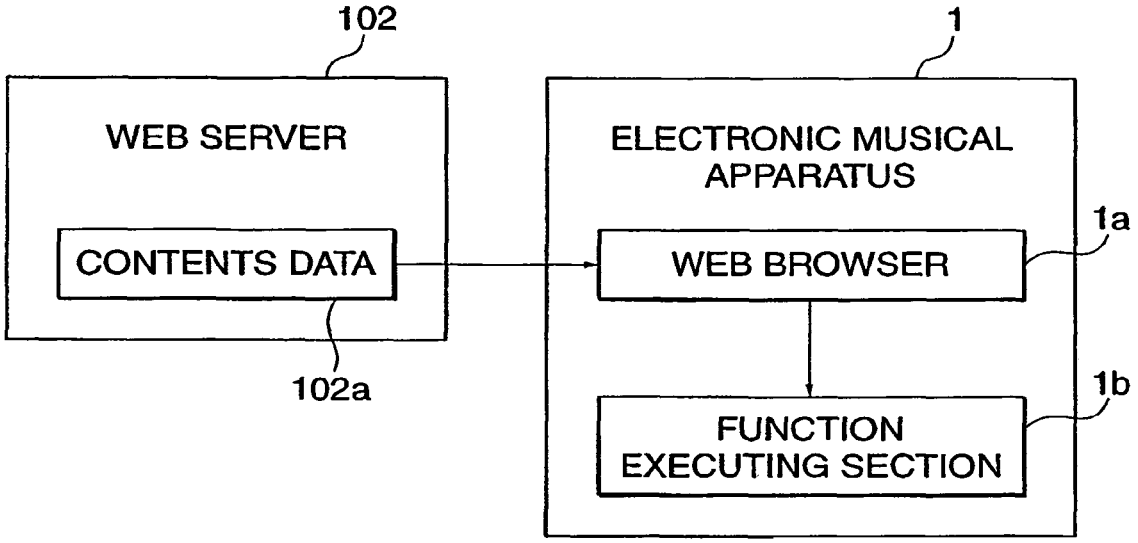
FIG. 2 is a block diagram schematically showing the functional configurations of the electronic musical apparatus in FIG. 1 and a Web server.

FIG. 2 is a block diagram schematically showing the functional configurations of the electronic musical apparatus 1 and the Web server 102.

As shown in FIG. 2, the electronic musical apparatus 1 is comprised of a Web browser 1*a* that acquires Web contents data (hereinafter simply referred to as "the contents data") stored in, for example, an external storage device, not shown, attached to the Web server 102 and executes a function of displaying the acquired contents data 102*a* on the display 9, and a function executing section 1*b* that executes functions of the electronic musical apparatus 1 in accordance with a control command or control commands (for executing one or more predetermined functions of the electronic musical apparatus 1) written (embedded) in the contents data 102*a*.

The Web browser 1*a* and the function executing section 1*b* are realized by software. Specifically, the Web browser 1*a* is realized by a Web browser program being executed by the CPU 6, and the function executing section 1*b* is realized by a function executing program being executed by the CPU 6. The Web browser program and the function executing program are stored in, for example, the external storage device 11 and loaded into the RAM 8 when they are used.

The Web server 102 stores the contents data 102*a* in the above-mentioned external storage device. Although only one piece of contents data 102*a* is shown in FIG. 2, this contents data 102*a* is one which has been requested to be distributed (downloaded) by the Web browser 1*a* among a plurality of pieces of contents data; that is, it does not mean that only one piece of contents data 102*a* is stored in the external storage device. Typically, plural pieces of contents data are stored in the external storage device. The contents data 102*a* may be statistically (fixedly) created by the user who uses the Web server 102 or dynamically created by a CPU, not shown, of the Web server 102 based on some information transmitted from the Web browser 1*a*.

As will be understood from the above described construction, the electronic musical apparatus 1 is constructed on an electronic musical instrument.

In the case where the electronic musical apparatus 1 is implemented by an electronic musical instrument, the electronic musical instrument should not necessarily be a keyboard musical instrument, but may be a stringed instrument, a wind instrument, a percussion instrument, or the like. Further, a tone generator apparatus, an electronic musical apparatus, and so forth should not necessarily be incorporated into the main body of one electronic musical instrument, but may be configured as separate bodies and connected to each other via some communication means such as a MIDI I/F and various kinds of networks.

Further, the electronic musical apparatus 1 according to the present embodiment may be constructed on a dedicated apparatus, other than an electronic musical instrument, which is comprised of the minimum elements that can practice the present invention. Examples of the dedicated apparatus include a karaoke machine, a game machine, and a portable communication terminal such as a cellular phone. In the case where a portable communication terminal is used, it should not necessarily be configured such that predetermined functions can be realized by the terminal alone, but part of the functions may be assigned to a server so that a system comprised of the terminal and the server can realize the functions. Alternatively, the electronic musical apparatus 1 according to the present embodiment may be constructed on a general-purpose personal computer.

Referring to FIGS. 3 to 6, a detailed description will now be given of control processes carried out by the electronic musical apparatus 1 constructed as described above.

Figure 3:
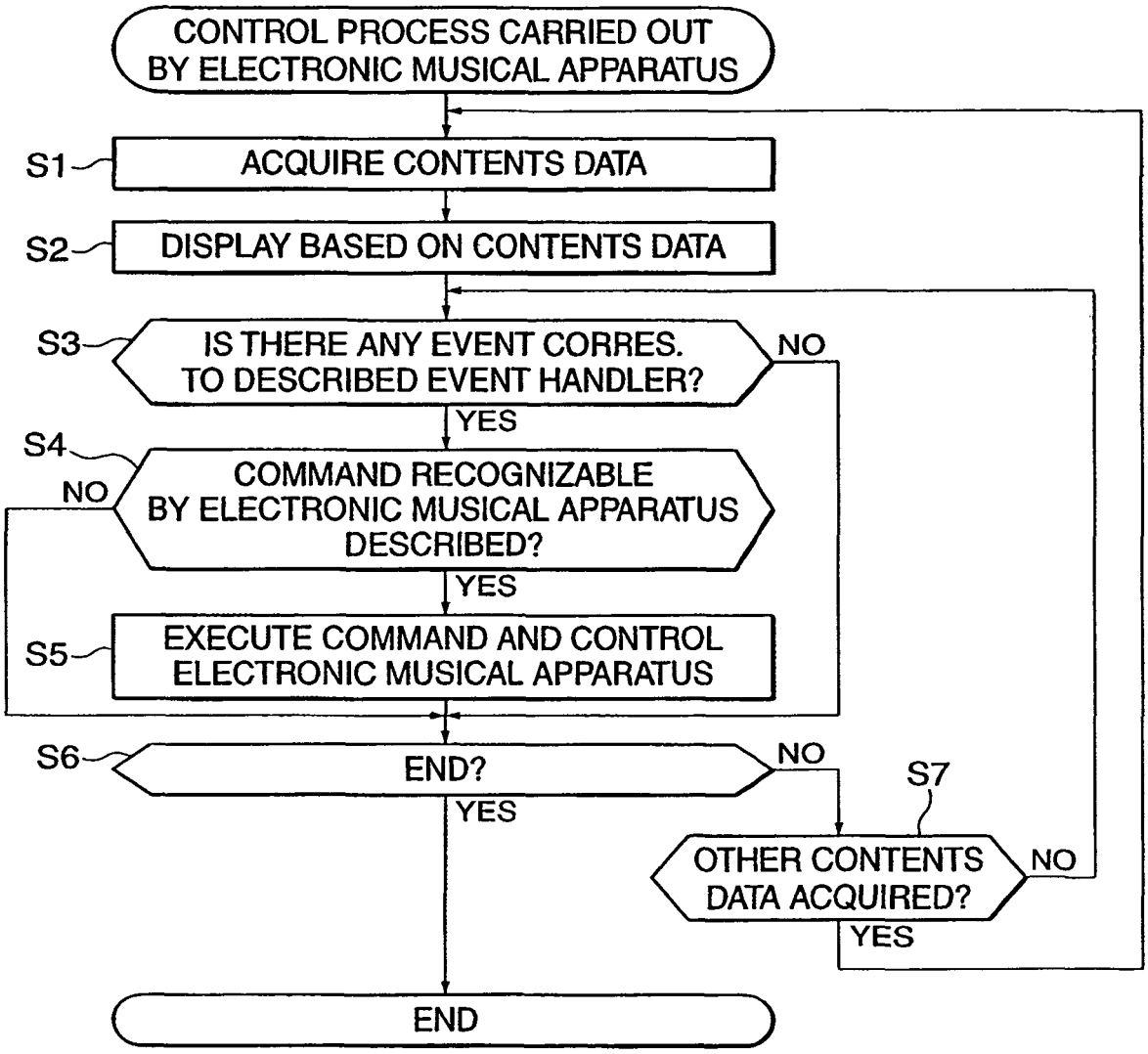
FIG. 3 is a flow chart showing the procedure of a control process carried out by the electronic musical apparatus in FIG. 1, in particular, by the Web browser and a function executing section thereof.

FIG. 3 is a flow chart showing the procedure of a control process carried out by the electronic musical apparatus 1, in particular, by the Web browser 1*a* and the function executing section 1*b*. In FIG. 3, processing in steps S1 to S3, S6, and S7 corresponds to processing performed by the Web browser 1*a*, and processing in steps S4 and S5 corresponds to processing performed by the function executing section 1*b* that functions as a control device. It should be noted, however, that in actuality, the processing executed by the Web browser 1*a* and the function executing section 1*b* is performed by the CPU 6.

If contents data which has been requested to be downloaded by the user on the Web browser 1*a* for example is stored within the Web server 102, the Web browser 1*a* accesses the Web server 102 via the communication I/F 13 and the communication network 101 to request distribution of the contents data 102*a*.

Responsive to this access, the Web server 102 sends the contents data 102*a*, which has been requested to be distributed, to the Web browser 1*a* via the communication network 101.

The Web browser 1*a* functions as an acquiring device and a display device; it receives (acquires) the sent contents data 102*a* via the communication I/F 13 (step S1) and displays Web page data on the display 10 based on the contents data 102*a* (step S2).

Figure 5:
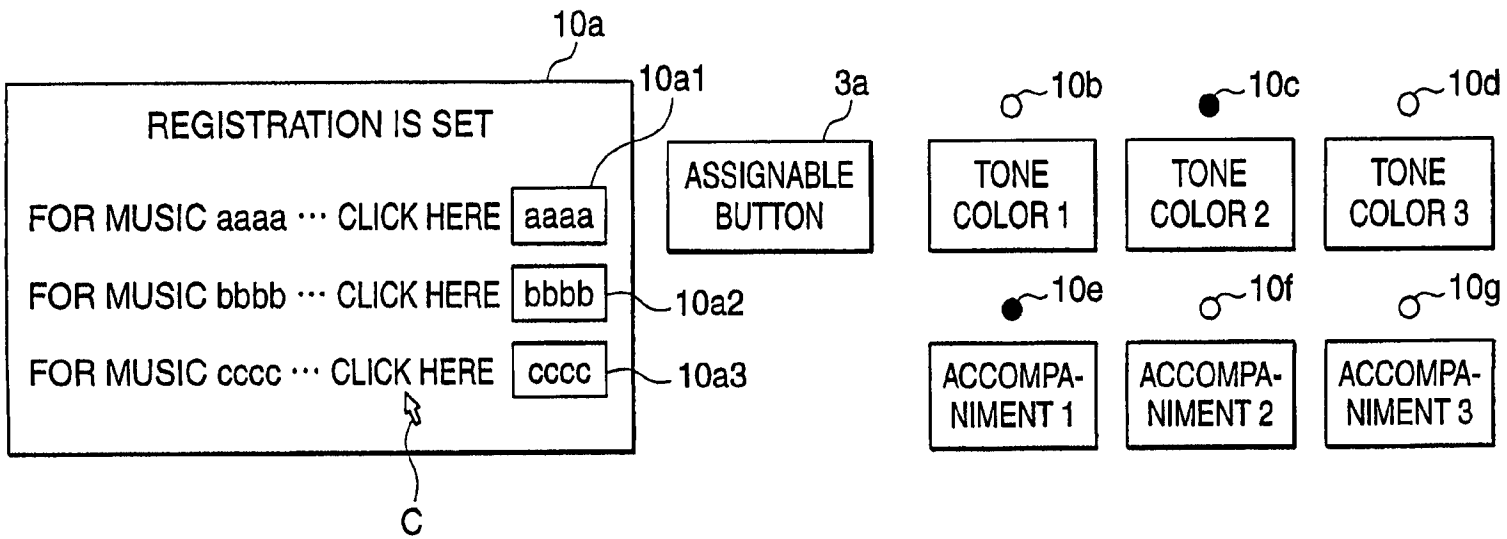
FIG. 5 is a view showing an example of the layout of a panel of the electronic musical apparatus, including a screen displayed based on the contents data in FIG. 4.

FIG. 4 is a view showing an example of description of the contents data 102*a* in HTML (Hypertext Markup Language), and FIG. 5 is a view showing an example of the layout of a panel of the electronic musical apparatus 1, including a screen displayed based on the contents data 102*a* in FIG. 4.

On the panel shown in FIG. 5, an LCD 10*a* and LEDs 10*b* to 10*g* are provided as the display 10, and an assignable button 3*a* is provided as one of the setting operators 3.

The Web browser 1*a* displays a screen on the LCD 10*a* based on the description of a part enclosed by "Body" tags in the contents data 102*a* in FIG. 4. Consequently, on the LCD 10*a* in FIG. 5, a message "Registration is set" is displayed on the first line, a message "For music aaaa . . . Click here" is displayed and then a button 10*a*1 on which characters "aaaa" are written is displayed on the next line, a message "For music bbbb . . . Click here" is displayed and then a button 10*a*2 on which characters "bbbb" are written is displayed on the next line, and a message "For music cccc . . . Click here" is displayed and then a button 10*a*3 on which characters "cccc" are written is displayed on the bottom line.

Referring again to FIG. 3, it is determined whether or not there is any event corresponding to an event handler written in the contents data 102*a* (step S3). The event handler included in the contents data 102*a* of FIG. 4 is "on Click" enclosed by an INPUT tag and calls the corresponding function when the corresponding button is clicked. For example, the button 10*a*1 displayed on the LCD 10*a* in FIG. 5 is clicked by a cursor C, a function "Button1( )" is called. That is, if there is any event corresponding to the event handler, this means that there is an event in which any of the three displayed buttons 10*a*1 to 10*a*3 is clicked. It should be noted that the display element associated with the event handler is not limited to the above-mentioned button, but may be anything such as a character string or an icon.

If it is determined in the step S3 that there is any event corresponding to the event handler written in the contents data 102*a*, it is then determined whether or not the corresponding command can be recognized by the electronic musical apparatus 1 (step S4). If the corresponding command can be recognized by the electronic musical apparatus 1, the function executing section 1*b* is caused to execute the command, so that the electronic musical apparatus 1 is controlled in accordance with the contents of the command (step S5) For example, when the button 10*a*2 displayed on the LCD 10*a* in FIG. 5 is clicked, a function "Button2( )" is called in FIG. 4. The function "Button2( )" includes a command "SetAssignableButton(Registration2)." The function executing section 1*b* executes this command because in the present embodiment, commands enclosed by EMIcom tags can be recognized by the electronic musical apparatus 1. Here, the command "SetAssignableButton(Registration2)" is for assigning a second registration (set data) that is set (stored) in advance in the electronic musical apparatus 1 to the assignable button 3*a* in FIG. 5. When this command is executed by the function executing section 1*b*, the electronic musical apparatus 1 is controlled such that the second registration is assigned to the assignable button 3*a*. Here, assuming that a tone color 2 and an accompaniment 1 are set as the second registration, since the second registration is assigned to the assignable button 3*a*, when the user presses the assignable button 3*a*, the tone color 2 and the accompaniment 1 are set to the electronic musical apparatus 1, and as a result, the LEDs 10*c* and 10*e* light up as shown in FIG. 5.

Referring again to FIG. 3, the steps S3 to S5 are repeatedly executed until the user acquires other contents data. When the user has acquired the other contents data, the process returns to the step S1, and the steps S1 to S5 are repeatedly executed. When the user requests termination of the Web browser 1*a*, the control process is terminated.

It should be noted that the electronic musical apparatus 1 carries out processes for various functions provided in the electronic musical apparatus 1 in parallel with the above described control process.

FIG. 6 is a view showing another example of description of the contents data 102*a* in HTML.

When the Web browser 1*a* acquires the contents data 102*a* of FIG. 6, a message "Registration has been set to button" is displayed on the LCD 10*a* in the aforementioned step S2, and then an event handler "on Load" is automatically executed to call a function "Auto( )." The function "Auto( )" includes a command "SetAssignableButton(Registration1)", which can be recognized by the electronic musical apparatus 1 since it is enclosed by the EMIcom tags, and therefore the function executing section 1*b* executes this command. The control method carried out in response to the execution of this command is the same as the one carried out in response to the execution of the aforementioned command "SetAssignableButton(Registration2)", and therefore description thereof is omitted.

Thus, in the case where the user has to select a command to be executed by the function executing section 1*b*, the contents data 102*a* of FIG. 4 is used, and in the case where the user does not have to select a command to be executed by the function executing section 1*b* (i.e. a command is uniquely determined), the contents data 102*a* of FIG. 6 is used.

Although in FIG. 6, only one command to be executed is written in the contents data 102*a* of FIG. 6, the present invention is not limited to this, but a plurality of commands may be combined to be executed. If a plurality of commands are combined, all of them may be executed substantially at the same time or may be sequentially executed as time passes.

Also, in the present embodiment, a command for assigning a predetermined function to the assignable button 3*a* is embedded in the contents data 102*a*, any kind of command may be embedded, such as an operation command assigned to an existing button (for example, a command to set on "tone color 2", a command to set on "accompaniment 3", or a command to load desired music data from an external storage medium and start reproduction of the loaded music data). Preferably, not only a command but also a music contents material (such as MIDI data, audio data, musical score data, or music-related image data) is included in the contents data 102*a*, and a command that gives instructions in response to reproduction of the music contents material is embedded in the contents data 102*a*. For example, it can be envisaged that a music contents material is MIDI data indicative of the chord progression of a predetermined musical composition, and a command is for selecting the tone color and the accompaniment style in the performance of a melody by the user. In such a case, as the chord progression of a predetermined musical composition based on MIDI data is reproduced, tone color and accompaniment style suitable for the predetermined musical composition can be automatically set.

Further, although in the present embodiment, only one assignable button 3*a* is provided, the present invention is not limited to this, but a plurality of assignable buttons may be provided. In this case, commands for the respective assignable buttons are embedded in the contents data 102*a*.

It is preferred that presenting information for, after a function is assigned to an assignable button, presenting what kind of function has been assigned to the assignable button, what will happen in response to the operation of the assignable button to which the function has been assigned, and so forth to the user is embedded in the contents data 102*a*. For example, it can be envisaged that a command for displaying an alarm window in which the presenting information is written is embedded in the contents data 102*a*.

Further, the function that is assigned to the assignable button 3*a* is not limited to the one realized within the electronic musical apparatus 1 (the above described registration setting), but a function that cooperates with another apparatus may be assigned to the assignable button 3*a*. For example, a function of sending predetermined data stored in a storage device such as the RAM 8 of the electronic musical apparatus 1 or the external storage device 11 (such as information on user's performance or information on a text input on the screen) from the electronic musical apparatus 1 to the Web server 102 as an external apparatus by pressing the assignable button 3*a* may be assigned to the assignable button 3*a*.

Although in the present embodiment, a physical button is used as the assignable button 3*a*, the present invention is not limited to this, but a button provided in a predetermined area on the screen (a button created by software) may be used.

Further, the contents data should not necessarily be acquired from the Web server 102, but may be supplied from an external storage medium to the electronic musical apparatus 1.

Further, although in the present embodiment, an event handler according to Java (registered trademark) Script is used to cause the electronic musical apparatus 1 to execute a command embedded in the contents data 102*a*, other methods may be used.

Further, although in the present embodiment, the buttons on the screen are clicked using the mouse, the present invention is not limited to this, but the buttons may be clicked by touching them insofar as the display 10 is a touch panel type. Alternatively, it may be configured such that predetermined operating elements (such as switches provided in the vicinity of the display 10) on the electronic musical apparatus 1 are associated with the buttons, so that the buttons can be clicked by operating the operating elements. Alternatively, it may be configured such that by operating a predetermined operating element (such as a "cursor" switch for indicating upward/downward/right/left directions) on the electronic musical apparatus 1, any of the buttons on the screen is selected, and in this state, the selected button is clicked by operating another operating element (such as an "execution" switch).

As described above, in the present embodiment, commands for executing functions provided in advance in the electronic musical apparatus 1 are embedded in the contents data 102*a*, and functions corresponding to the commands are executed. As a result, it is possible to execute functions provided in advance in the electronic musical apparatus 1.

Next, a description will be given of an electronic musical apparatus 1' according to a second embodiment of the present invention.

The electronic musical apparatus 1' according to the second embodiment differs from the electronic musical apparatus 1 according to the above described first embodiment only in control process. Therefore, the hardware of the electronic musical apparatus 1' is the same as that of the electronic musical apparatus 1 according to the first embodiment, which is shown in FIG. 1. Also, the hardware of a Web server 102' according to the second embodiment is the same as that of the Web server 102 according to the above described first embodiment.

Figure 7:
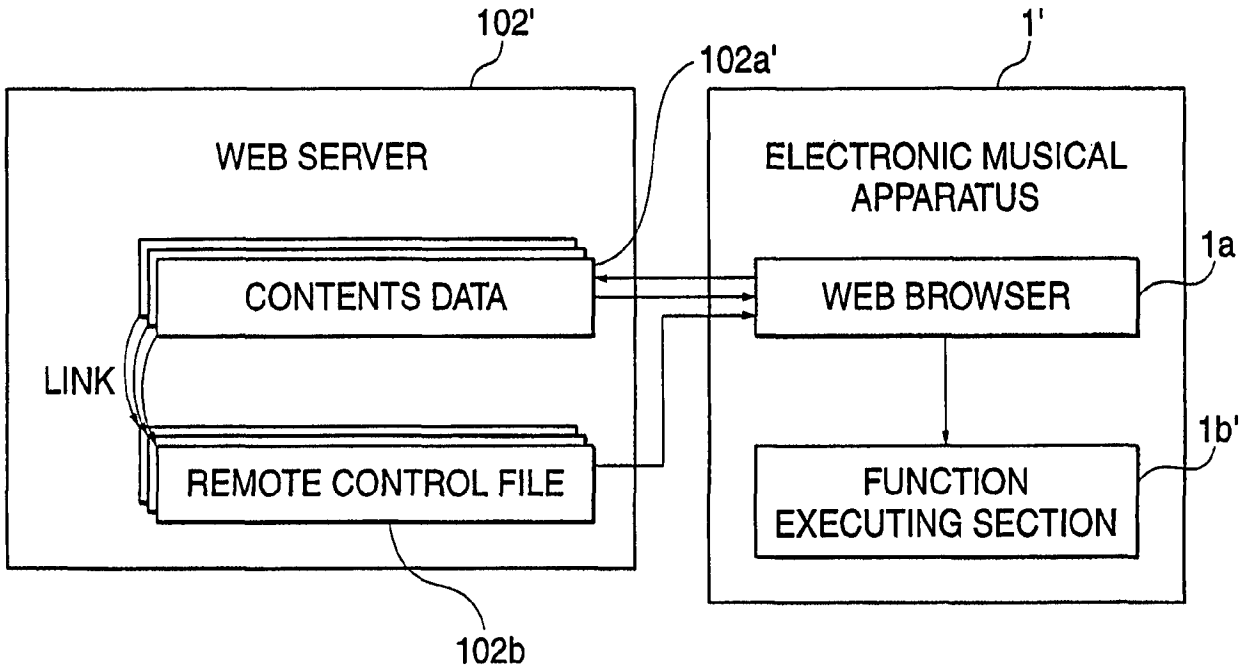
FIG. 7 is a block diagram schematically showing the functional configurations of an electronic musical apparatus and a Web server according to a second embodiment of the present invention.

FIG. 7 is a block diagram schematically showing the functional configurations of the electronic musical apparatus 1' and the Web server 102', and corresponds to FIG. 2 showing the above described first embodiment. In FIG. 7, component elements corresponding to those appearing in FIG. 2 are denoted by the same reference numerals, and therefore description thereof is omitted.

As shown in FIG. 7, the Web server 102' stores a plurality of pieces of contents data 102*a*' in, for example, an external storage device, not shown. Each piece of the contents data 102*a*' is linked to one remote control file 102*b*.

Figure 8:
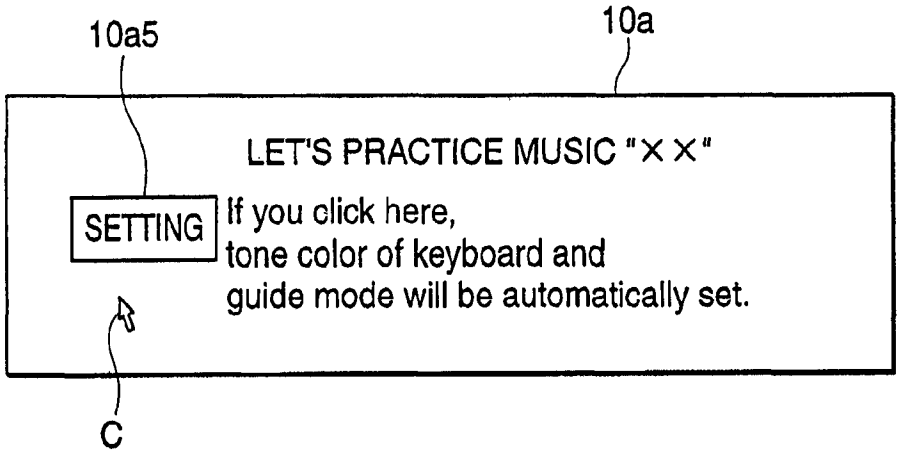
FIG. 8 is a view showing an example of contents data appearing in FIG. 7.

FIG. 8 is a view showing an example of the contents data 102*a*', i.e. a screen displayed when the Web browser 1*a* displays a piece of the contents data 102*a*' for display on the LCD 10*a*.

In the contents data 102*a*' shown in FIG. 8, a setting button 10*a*5 configured by software is linked to the remote control file 102*b*. It is quite a matter of course that anything such as a character string or an icon based on the contents data 102*a*' as well as the button may be linked to the remote control file 102*b* insofar as it is a display element (indicator element). Although in the present embodiment, each piece of contents data is linked to one remote control file, the present invention is not limited to this, but each piece of contents data may be linked to a plurality of remote control files. Alternatively, contents data linked to one remote control file and contents data linked to a plurality of remote control files may be mixed in the plurality of contents data 102*a*'. Further, a plurality of pieces of contents data may be linked to a common remote control file (in which frequently used functions and settings are described).

The remote control file 102*b* is a file to which a predetermined file extension is appended and is identified as a remote control file by this file extension. As described later in detail, when the file to which the file extension is appended, i.e. the remote Control file 102*b* is downloaded, the Web browser 1*a* activates a function executing function (function executing program) 1*b*' and transfers the process to the function executing section 1*b*' so that the function executing section 1*b*' can perform subsequent processing on the remote control file 102*b*.

FIG. 9A is a diagram showing an example of the data format of the remote control file 102*b*, and FIG. 9B is a diagram showing an example of remote control data written in the remote control file 102*b*.

As shown in FIG. 9A, at least one piece of remote control data is written in the remote control file 102*b*. Typically, a plurality of pieces of remote control data are written in the remote control file 102*b* because there are various kinds of remote control data as shown in FIG. 9B. Therefore, in the following description, it is assumed that a plurality of pieces of remote control data are written in the remote control file 102*b*, but it is to be understood that the present invention can be realized even in the case where only one piece of remote control data is written in the remote control file 102*b*.

The remote control data is comprised of one or more control commands for executing one or more predetermined functions of the electronic musical apparatus 1' as is the case with the control commands of the above described first embodiment. The function executing section 1*b*' interprets each piece of remote control data to execute the corresponding function (s). As a result, the corresponding function(s) of the electronic musical apparatus 1' can be remote-controlled from the Web server 102'.

FIG. 9B shows examples of functions that can be remote-controlled using remote control data, as well as examples of their descriptions. A brief description will now be given of the examples of the functions shown in FIG. 9B.

(1) Panel screen: a function of opening or closing a lyric/score screen on the LCD 10*a*, and the example of description indicates the function of opening a score screen ("SCORE").

(2) Song control: there are two kinds of functions consisting of "reproduction control" and "bar shift." The "reproduction control" function is a function of controlling the reproduction of a song (reproduction of musical composition data (performance data)); controllable reproduction states include starting, stopping, and pause. The "bar shift" function is a function of shifting bars to be reproduced, of a song. The example of description indicates the function of stopping the reproduction of a song.

(3) Song setting: a function of setting the volume value of a song generated based on reproduction of musical composition data (performance data); the example of description indicates the function of setting an absolute value "100" as the volume value, but a relative value may be set as the volume value.

(4) Tempo setting: a function of setting the tempo value of a song generated based on reproduction of musical composition data (performance data); the example of description indicates the function of setting an absolute value "120" as the tempo value, although a relative value may be set as the tempo value.

(5) Transpose setting: a function of setting the transpose value of a keyboard or a song to be reproduced; the example of description indicates the function of setting an absolute value "5" as the transpose value, although a relative value may be set as the transpose value.

(6) Guide setting: there are seven functions consisting of "guide ON/OFF setting", "guide mode setting", "guide lamp ON/OFF setting", "guide lamp timing setting", "left-channel setting", "right-channel setting", and "auto-channel ON/OFF setting." The "guide ON/OFF setting" function is a function of enabling (ON)/disabling (OFF) a guide function for guiding user's performance, such as lighting up a predetermined position of a key. The "guide mode setting" function is a function of setting one from among a plurality of guide modes. The "guide lamp ON/OFF setting" function is a function of setting ON/OFF a guide lamp. The "guide lamp timing setting" function is a function of setting timing of the guide lamp to JUST/NEXT. The "left channel setting" function is a function of changing channels to be assigned to the left channel. The "right channel setting" function is a function of changing channels to be assigned to the right channel. The "auto-channel ON/OFF setting" is a function of setting whether channels to be assigned to the right/left channels are to be automatically set (ON) or not (OFF). The example of description indicates the function of setting the guide function to "ON", the guide lamp to "ON", the left channel to "OFF", and the right channel to "1."

(7) Keyboard tone setting: a function of setting the tone color, volume value, reverb depth value, and DSP (Digital Signal Processor) depth value for keyboard tones generated based on operation of the keyboard; the example of description indicates the function of setting bank select MSB (Most Significant Bit) of a main tone color to "0", bank select LSB (Least Significant Bit) of the main tone color to "112", the program change to "6", and the volume value to an absolute value. "100."

(8) Automatic accompaniment setting: a function of enabling (ON)/disabling (OFF) automatic accompaniment; the example of description indicates the function of disabling (OFF) automatic accompaniment.

(9) Automatic performance musical composition reproduction: a function of designating how many pieces of music there are before or after the present piece of music being automatically reproduced; the example of description indicates the function of instructing reproduction of the next piece of music.

(10) Song track: there are two functions consisting of "song track solo setting" and "song track play/mute setting." The "song track solo setting" function is a function of setting a designated song track to solo (the other tracks are muted) among a predetermined number of song tracks constituting a song, or canceling solo setting. The "song track play/mute setting" function is a function of individually setting designated song tracks to play or to mute. The example of description indicates the function of setting on individual tracks 1 and 2 and setting off individual tracks 3, 10, and 16.

(11) Bulk setting: a function of collectively setting the state of a musical instrument. In the example of description, the state of the electronic musical apparatus 1' is set to a predetermined reset state (for example, the right-hand part of the keyboard is off, the left-hand part of the keyboard is off, and accompaniment is off).

It should be noted that items and functions to be set should not be limited to the examples given above. Also, it should be noted that the items and functions mentioned above can be used in the above described first embodiment as well.

Figure 10:
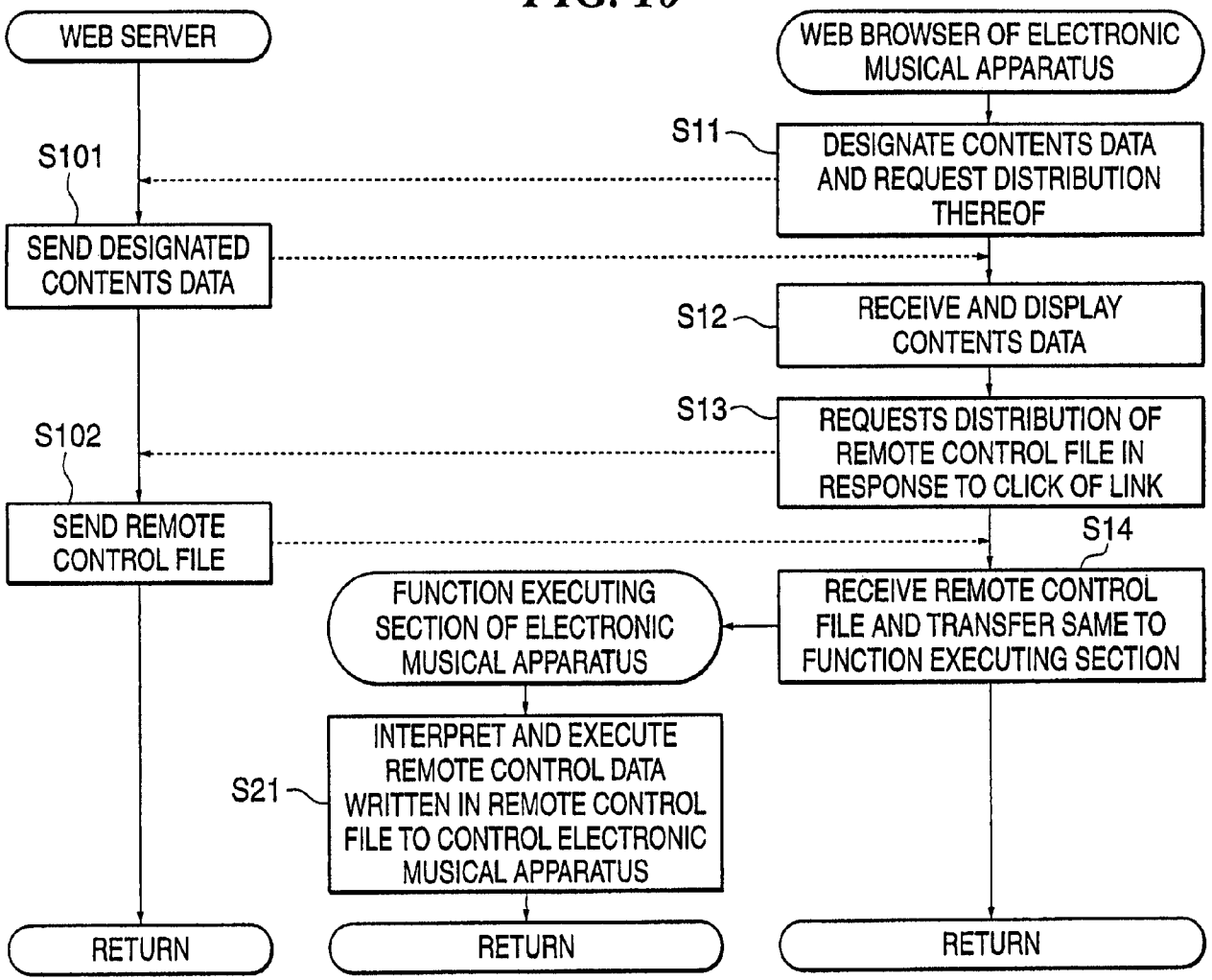
FIG. 10 is a flow chart showing the procedure of a control process carried out by the electronic musical apparatus and the Web server in FIG. 7.

Referring to FIG. 10, a detailed description will now be given of a control process carried out by the electronic musical apparatus 1' and the Web server 102' constructed as described above.

FIG. 10 is a flow chart showing the procedure of the control process carried Out by the electronic musical apparatus 1' and the Web server 102'.

As shown in FIG. 10, first, when the user designates desired contents data 102*a*' in the Web server 102' via the Web browser 1*a* of the electronic musical apparatus 1' and requests distribution of the contents data 102*a*', the Web browser 1*a* accesses the Web server 102' via the communication I/F 13 and the communication network 101 to request distribution of the contents data 102*a*' (step S11).

Responsive to this access, the Web server 102' sends the contents data 102*a*', which has been requested to be distributed, to the Web browser 1*a* via the communication network 101 (step S101).

The Web browser 1*a* functions as a first acquiring device and a display device; it receives (acquires) the sent contents data 102*a*' via the communication I/F 13 and displays Web page data on the display 10 based on the contents data 102*a*' (step S12). As a result, the screen shown in FIG. 8, for example, is displayed on the LCD 10*a* of the display 10. On the illustrated screen, a cursor C is displayed, too, and hence when the user operates the mouse or the like to place the cursor C on the setting button 10*a*5 and click the same, the Web browser 1*a* accesses the Web server 102' to request distribution of the remote control file 102*b* since the setting button 10*a*5 is linked to the remote control file 102*b* as mentioned above (step S13). It should be noted that an operation performed on the setting button 10*a*5 is not limited to the above-mentioned clicking operation using the mouse or the like, but the setting button 10*a*5 may be operated using a touch-sensitive panel provided on the display or using a switch provided around the display 10 and in the vicinity of the setting button 10*a*5.

Responsive to this access, the Web server 102' sends the remote control file 102*b*, which has been requested to be distributed, to the Web browser 1*a* via the communication network 101 (step S102).

The Web browser 1*a* functions as a second acquiring device; it receives (acquires) the sent remote control file 102*b* via the communication I/F 13 and transfers the process therefor to the function executing section 1*b*' (step S14). In the step S14, on the assumption that the file received by the Web browser 1*a* is the remote control file 102*b*, the process therefor is immediately transferred to the function executing section 1*b*'. However, the file received by the Web browser 1*a* is not limited to the remote control file 102*b*, and hence the Web browser 1*a* actually determines whether or not the received file is the remote control file 102*b* according to whether or not the file extension appended to the received file indicates that the received file is the remote control file. Then, if determining that the file extension indicative of the remote control file is appended to the received file, the Web browser 1*a* transfers the process therefor to the function executing section 1*b*'. On the other hand, if determining that a file extension other than the one indicative of the remote control file is appended to the received file, the Web browser 1*a* performs processing in accordance with the type of the file.

When the process is transferred to the function executing section 1*b*', the function executing section 1*b*' functions as a control device to interpret remote control data written in the remote control file 102*b* and execute functions thereof to thereby control the electronic musical apparatus 1' (step S21. As mentioned above, the remote control data is for executing predetermined functions of the electronic musical apparatus 1', and there are a number of functions which can be controlled by the remote control data. The remote control file 102*b* contains remote control data that executes at least part of the functions, and therefore the function executing function 1*b*' sequentially interprets the remote control data written in the remote control file 102*b* and executes functions thereof so that the corresponding functions can be executed. However, there may be a case where remote control data for executing functions which are not provided in the electronic musical apparatus 1' is written in the remote control file 102*b*. In this case, the function executing section 1*b*' merely interprets such remote control data without executing the functions thereof.

Although in the present embodiment, the contents data 102*a*' is created in advance and stored in the Web server 102', the present invention is not limited to this, but it may be configured such that the contents data 102*a*' is dynamically generated in response to access from the electronic musical apparatus 1', and the Web browser 1*a* acquires the dynamically created contents data 102*a*' from the Web server 102'.

As described above, according to the present embodiment, link information indicative of a link to the remote control file 102*b* in which remote control data for executing functions provided in advance in the electronic musical apparatus 1' is written is included in the contents data 102*a*', and when the user performs a predetermined operation such as mouse click on the link information presented on the screen displayed in the Web browser 1*a*, the file 102*b* linked by the link information is acquired, and the remote control data written in the acquired file 102*b* is interpreted and functions thereof are executed, so that the corresponding functions of the electronic musical apparatus 1' are executed. Therefore, functions provided in advance in the electronic musical apparatus 1' can be executed.

Also, the remote control file 102*b* is formed as a file separate from a file containing the contents data 102*a*', and hence a plurality of pieces of contents data 102*a*' can share one remote control file 102*b*. Further, the contents data 102*a*' can be easily created since it is only necessary to include link information indicative of a link to the remote control file 102*b* in the contents data 102*a*'.

It is to be understood that the object of the present invention may also be accomplished by supplying a system or an apparatus with a storage medium in which a program code of software, which realizes the functions of either of the above described embodiments is stored, and causing a computer (or the CPU 6 or MPU) of the system or apparatus to read out and execute the program code stored in the storage medium.

In this case, the program code itself read from the storage medium realizes the functions of either of the above described embodiments, and hence the program code and a storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, and a DVD+RW, a magnetic tape, a nonvolatile memory card, and a ROM. Alternatively, the program code may be downloaded from a server computer via a communication network.

Further, it is to be understood that the functions either of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided in an expansion board inserted into a computer or a memory provided in an expansion unit connected to the computer and then causing the CPU 6 or the like provided in the expansion board or the expansion unit to perform a part or all of the actual operations based on instructions of the program code.

What is claimed is:

1. An electronic musical instrument that is capable of generating a musical performance in response to designation of a musical note comprising:

a first acquiring device that acquires contents data including link information and display data, wherein the link information is indicative of a link to a remote control file in which at least one command for instructing execution of at least one predetermined function of the electronic musical instrument is written, wherein the display data is used for displaying a predetermined screen including a display element associated with the link information and an explanation relating to the predetermined function, wherein the remote control file is stored in a server on a network and wherein the at least one predetermined function of the electronic musical instrument is used to configure the electronic musical instrument for generating the musical performance in response to designation of a musical note;

a display device that displays the predetermined screen based on the display data included in the contents data acquired by said first acquiring device;

a second acquiring device that is operable when a user performs a predetermined operation on the display element on the predetermined screen displayed by said display device, to acquire the remote control file linked by the link information from the server; and a control device that interprets the at least one command written in the remote control file acquired by said second acquiring device and controls the electronic musical instrument to execute the at least one predetermined function indicated by the interpreted command.

2. An electronic musical instrument according to claim 1, wherein said first acquiring device, said display device, and said second acquiring device are realized by a browser, said control device is realized by a function executing section, and said browser activates said function executing section to execute the at least one predetermined function indicated by the interpreted command.

3. An electronic musical instrument according to claim 2, wherein a file extension is appended to the file, and said browser identifies the file extension to activate said function executing section.

4. An electronic musical instrument according to claim 1, wherein said control device controls the electronic musical instrument not to execute the function indicated by the interpreted command when the function indicated by the interpreted command is a function that is not provided in the electronic musical instrument.

5. An electronic musical instrument according to claim 1, wherein the contents data comprises a plurality of contents data and said plurality of contents data each includes link information indicative of a link to the remote control file.

6. An electronic musical instrument according to claim 1, wherein the function executed under control of said control device includes at least one function selected from the group consisting of a function of opening or closing a screen on said display device, a function of controlling reproduction of musical composition data, a function of setting a volume value of a song to be reproduced based on musical composition data, a function of setting a tempo value of a song to be reproduced based on musical composition data, a function of setting a transpose value of a keyboard or a song to be reproduced, a function relating to setting of performance guide, a function relating to setting of a tone to be generated by operation of a keyboard, a function relating to setting of automatic accompaniment, a function of designating a musical composition to be automatically reproduced before or after a current musical composition, a function relating to setting as to reproduction of a song track, a function of collectively setting of status of the electronic musical instrument, a function of assigning setting data for setting tone color or accompaniment of a musical composition to be performed based on musical composition data to a predetermined operating element of the electronic musical instrument, a function of setting tone color or accompaniment of a musical composition, a function of loading musical composition data from an external storage medium and instructing reproduction of the loaded musical composition data, and a function of assigning an instruction for sending data to an external apparatus to a predetermined operating element of the electronic musical instrument.

7. An electronic musical instrument according to claim 1, wherein the contents data further includes music contents data.

8. An electronic keyboard musical instrument comprising:

a musical keyboard for inputting pitch information;

at least one button, provided on a panel, to which a tone color stored in the electronic keyboard musical instrument is assigned in advance;

a communication interface that connects the electronic keyboard musical instrument to a server computer via a network;

an acquiring device that acquires contents data distributed from the server computer via said communication interface, said contents data including at least one command indicative of an instruction for setting on the tone color that is assigned to the button a control device that interprets the at least one command included in the contents data acquired by said acquiring device and controls the electronic keyboard musical instrument to set on the tone color; and a tone generator circuit that receives performance data including pitch information input in response to a user's operation of said musical keyboard, and generates musical tone signals having the set-on tone color and a pitch corresponding to the input pitch information.

9. An electronic keyboard musical instrument according to claim 8, wherein the contents data further includes music contents data.

10. An electronic keyboard musical instrument according to claim 8, wherein the control device starts interpreting the at least one command automatically after the acquiring device acquires the contents data.

11. An electronic keyboard musical instrument comprising:

a musical keyboard for inputting pitch information;

at least one button, provided on a panel, to which a tone color stored in the electronic keyboard musical instrument is assigned in advance;

a communication interface that connects the electronic keyboard musical instrument to a server computer via a network;

an acquiring device that acquires contents data distributed from the server computer via said communication interface, said contents data including at least one command indicative of an instruction for setting on the tone color that is assigned to the button and display data for displaying a predetermined screen;

a display device that displays the predetermined screen based on the display data included in the contents data acquired by said acquiring device;

a control device that interprets the at least one command included in the contents data acquired by said acquiring device and controls control the electronic keyboard musical instrument to set on the tone color; and a tone generator circuit that receives performance data including pitch information input in response to a user's operation of said musical keyboard, and generates musical tone signals having the set-on tone color and a pitch corresponding to the input pitch information.

12. An electronic keyboard musical instrument according to claim 11, wherein the contents data further includes music contents data.

13. An electronic keyboard musical instrument according to claim 11, wherein the predetermined screen has a display element as well as the explanation, and wherein, when a user performs a predetermined operation on the display element on the predetermined screen, the control device starts interpreting the at least one command.

14. An electronic keyboard musical instrument according to claim 11, wherein the control device starts interpreting the at least one command automatically after the predetermined screen is displayed by said display device.

15. An electronic keyboard musical instrument according to claim 11, wherein the control device interprets the at least one command included in the contents data when a user performs a predetermined operation on a display element on the predetermined screen displayed on the display device.

16. A control method for an electronic musical instrument that is capable of generating a musical performance in response to designation of a musical note, comprising:

a first acquiring step of acquiring contents data including link information and display data, wherein the link information is indicative of a link to a remote control file in which at least one command for instructing execution of at least one predetermined function of the electronic musical apparatus is written, wherein the display data is used for displaying a predetermined screen including a display element associated with the link information and an explanation relating to the predetermined function, wherein the remote control file is stored in a server on a network and wherein the at least one predetermined function of the electronic musical instrument is used to configure the electronic musical instrument for generating the musical performance in response to designation of a musical note;

a display step of causing a display device to display the predetermined screen based on the display data included in the contents data acquired in said first acquiring step;

a second acquiring step of acquiring the remote control file linked by the link information from the server when a user performs a predetermined operation on the display element on the predetermined screen displayed in said display step; and a control step of interpreting the at least one command written in the remote control file acquired in said second acquiring step and controlling the electronic musical instrument to execute the at least one predetermined function indicated by the interpreted command.

17. A control method for an electronic keyboard musical instrument comprising a musical keyboard for inputting pitch information, at least one button, provided on a panel, to which a tone color stored in the electronic keyboard musical instrument is assigned in advance and a communication interface that connects the electronic keyboard musical instrument to a server computer via a network, said control method comprising:

an acquiring step of acquiring contents data distributed from the server computer via said communication interface, said contents data including at least one command indicative of an instruction for setting on the tone color assigned to the button;

a control step of interpreting the at least one command included in the contents data acquired in said acquiring step and controlling the electronic keyboard musical instrument to set on the one color; and a tone generation step of receiving performance data including pitch information input in response to a user's operation of the musical keyboard and generating musical tone signals having the set-on tone color and a pitch corresponding to the input pitch information.

18. A control method for an electronic keyboard musical instrument comprising a musical keyboard for inputting pitch information, at least one button, provided on a panel, to which a tone color stored in the electronic keyboard musical instrument is assigned in advance, a communication interface that connects the electronic keyboard musical instrument to a server computer via a network and a display device, said control method comprising:

an acquiring step of acquiring contents data distributed from the server computer via said communication interface, said contents data including at least one command indicative of an instruction for setting on the tone color assigned to the button and display data for displaying a predetermined screen;

a display step of causing the display device to display the predetermined screen based on the display data included in the contents data acquired in said acquiring step; and a control step of, after the predetermined screen is displayed by the display step, interpreting the at least one command included in the contents data acquired in said acquiring step and controlling the electronic keyboard musical instrument to set on the tone color; and a tone generation step of receiving performance data including pitch information input in response to a user's operation of the musical keyboard and generating musical tone signals having the set-on tone color and a pitch corresponding to the input pitch information.

19. A non-transitory computer readable storage medium storing instructions for causing a computer to execute a control method for an electronic musical instrument that is capable of generating a musical performance in response to designation of a musical note, the control method comprising:

a first acquiring step of acquiring contents data including link information and display data, wherein the link information is indicative of a link to a remote control file in which at least one command for instructing execution of at least one of a predetermined function of the electronic musical instrument is written, wherein the display data is used for displaying a predetermined screen including a display element associated with the link information and an explanation relating to the predetermined function, wherein the remote control file is stored in a server on a network and wherein the at least one predetermined function of the electronic musical instrument is used to configure the electronic musical instrument for generating the musical performance in response to designation of a musical note;

a display step of causing a display device to display the predetermined screen based on the display data included in the contents data acquired in said first acquiring step;

a second acquiring step of acquiring the remote control file linked by the link information from the server when a user performs a predetermined operation on the display element on the predetermined screen displayed in said display step; and a control step of interpreting the at least one command written in the remote control file acquired in said second acquiring step and controlling the electronic musical instrument to execute the at least one predetermined function indicated by the interpreted command.

20. A non-transitory computer readable storage medium storing an instruction for causing a computer to execute a control method for an electronic keyboard musical instrument comprising a musical keyboard for inputting pitch information, at least one button, provided on a panel, to which a tone color stored in the electronic keyboard musical instrument is assigned in advance and a communication interface that connects the electronic keyboard musical instrument to a server computer via a network, the control method comprising:

an acquiring step of acquiring contents data distributed from the server computer via said communication interface, said contents data including at least one command indicative of an instruction for setting on the tone color assigned to the button a control step of interpreting the at least one command included in the contents data acquired in said acquiring step and controlling the electronic keyboard musical instrument to set on the tone color; and a tone generation step of receiving performance data including pitch information input in response to a user's operation of the musical keyboard and generating musical tone signals having the set-on tone color and a pitch corresponding to the input pitch information.

21. A non-transitory computer readable storage medium storing an instruction for causing a computer to execute a control method for an electronic keyboard musical instrument comprising a musical keyboard for inputting pitch information, at least one button, provided on a panel, to which a tone color stored in the electronic keyboard musical instrument is assigned in advance, a communication interface that connects the electronic keyboard musical instrument to a server computer via a network and a display device, the control method comprising:

an acquiring step of acquiring contents data distributed from the server computer via said communication interface, said contents data including at least one command indicative of an instruction for setting on the tone color assigned to the button and display data for displaying a predetermined screen;

a display step of causing the display device to display the predetermined screen based on the display data included in the contents data acquired in said acquiring step;

a control step of, after the predetermined screen is displayed by the display step, interpreting the at least one command included in the contents data acquired in said acquiring step and controlling the electronic keyboard musical instrument to set on the tone color; and a tone generation step of receiving performance data including pitch information input in response to a user's operation of the musical keyboard and generating musical tone signals having the set-on tone color and a pitch corresponding to the input pitch information.

* * * * *